US010945320B1

(12) United States Patent
Xiong

(10) Patent No.: US 10,945,320 B1
(45) Date of Patent: Mar. 9, 2021

(54) OUTPUT VOLTAGE CONTROL METHOD TO AVOID LED TURN-ON FLASH

(71) Applicant: Universal Lighting Technologies, Inc., Madison, AL (US)

(72) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 16/919,042

(22) Filed: Jul. 1, 2020

Related U.S. Application Data

(60) Provisional application No. 62/911,676, filed on Oct. 7, 2019.

(51) Int. Cl.

| | |
|---|---|
| ***H05B 45/30*** | (2020.01) |
| ***H05B 45/39*** | (2020.01) |
| ***H05B 45/382*** | (2020.01) |
| ***H05B 45/34*** | (2020.01) |

(52) U.S. Cl.
CPC ..... *H05B 45/39* (2020.01); *H05B 45/34* (2020.01); *H05B 45/382* (2020.01)

(58) Field of Classification Search
CPC ..... H05B 45/37; H05B 45/39; H05B 45/50; H05B 45/382
See application file for complete search history.

(56) References Cited

U.S. PATENT DOCUMENTS

| | | | |
|---|---|---|---|
| 2,561,855 | A | 7/1951 | Gould |
| 4,931,761 | A | 6/1990 | Kijima |
| 5,770,925 | A | 6/1998 | Konopka et al. |
| 5,926,946 | A | 7/1999 | Minato et al. |
| 6,018,467 | A | 1/2000 | Majid et al. |
| 6,057,652 | A | 5/2000 | Chen et al. |
| 6,545,432 | B2 | 4/2003 | Konopka |
| 6,720,739 | B2 | 4/2004 | Konopka |
| 6,980,077 | B1 | 12/2005 | Chandrasekaran et al. |
| 7,348,734 | B2 | 3/2008 | Yadlapalli |

(Continued)

OTHER PUBLICATIONS

International Rectifier: "IRS27951S Resonant Half-Bridge Converter Control IC", Aug. 25, 2015, 29 pages.

(Continued)

*Primary Examiner* — Tung X Le
(74) *Attorney, Agent, or Firm* — Patterson Intellectual Property Law, P.C.; Gary L. Montle; Jerry Turner Sewell

(57) ABSTRACT

A light-emitting diode (LED) driver circuit includes a DC-to-AC inverter that provides a primary AC voltage to the primary winding of an output transformer via a resonant tank circuit. The transformer has at least one secondary winding. An AC output voltage from the secondary winding is rectified to generate a DC voltage, which is applied to a load having a plurality of LEDs. An overshoot control circuit electrically connected in parallel with the primary winding of the transformer prevents the DC voltage applied to the load from exceeding the forward bias of the LEDs during startup conditions until the resonant tank circuit is stabilized. The overshoot control circuit includes a first diode and a first capacitor and further includes a second diode and a second capacitor. The first and second capacitors absorb energy during alternate half cycles of the primary AC voltage until the resonant tank circuit is stabilized.

15 Claims, 8 Drawing Sheets

(56) References Cited

U.S. PATENT DOCUMENTS

| | | | | |
|---|---|---|---|---|
| 7,646,281 | B2 | 1/2010 | Diekmann et al. | |
| 7,772,782 | B2 | 8/2010 | Chu et al. | |
| 8,031,042 | B2 | 10/2011 | Silva | |
| 8,723,428 | B2 | 5/2014 | Yao | |
| 8,742,674 | B2 | 6/2014 | Shteynberg et al. | |
| 8,847,512 | B1 | 9/2014 | Xiong | |
| 8,937,438 | B2 | 1/2015 | Chen | |
| 8,941,304 | B2 | 1/2015 | Goscha et al. | |
| 9,065,343 | B2 | 6/2015 | Hu | |
| 9,419,514 | B1 | 8/2016 | Xiong | |
| 9,769,890 | B1 | 9/2017 | Xiong et al. | |
| 9,787,195 | B1 | 10/2017 | Xiong et al. | |
| 9,837,913 | B1 | 12/2017 | Xiong | |
| 9,853,555 | B2 | 12/2017 | Ramabhadran et al. | |
| 10,098,194 | B1 | 10/2018 | Xiong | |
| 10,098,202 | B1 | 10/2018 | Xiong | |
| 10,447,148 | B2 * | 10/2019 | Elferich | H05B 45/37 |
| 2007/0285953 | A1 | 12/2007 | Koo et al. | |
| 2011/0068700 | A1 * | 3/2011 | Fan | H05B 45/44 315/185 R |
| 2011/0242856 | A1 | 10/2011 | Halberstadt | |
| 2012/0099344 | A1 | 4/2012 | Adragna | |
| 2012/0250360 | A1 | 10/2012 | Orr et al. | |
| 2013/0121037 | A1 | 5/2013 | Peng et al. | |
| 2013/0162157 | A1 | 6/2013 | Suzuki et al. | |
| 2013/0271021 | A1 * | 10/2013 | Elferich | H05B 45/37 315/206 |
| 2014/0091718 | A1 * | 4/2014 | Brinlee | H02M 1/4258 315/185 R |
| 2014/0091720 | A1 | 4/2014 | Brinlee | |
| 2015/0102742 | A1 | 4/2015 | Deng et al. | |
| 2015/0103562 | A1 | 4/2015 | Yeh et al. | |
| 2015/0124489 | A1 | 5/2015 | Dai et al. | |
| 2015/0245431 | A1 * | 8/2015 | Rutgers | H05B 45/37 315/210 |
| 2015/0257222 | A1 * | 9/2015 | Siessegger | H05B 45/39 315/186 |
| 2016/0073457 | A1 * | 3/2016 | Nakajo | H05B 45/37 315/223 |
| 2017/0093296 | A1 | 3/2017 | Chen | |
| 2017/0187298 | A1 | 6/2017 | Lin | |
| 2017/0222565 | A1 | 8/2017 | Sonobe | |
| 2018/0027619 | A1 | 1/2018 | Xiong et al. | |
| 2018/0262118 | A1 | 9/2018 | Ouyang | |

OTHER PUBLICATIONS

On Semiconductor: "NCP1392B, NCP1392D High-Voltage Half-Bridge Driver with Inbuilt Oscillator," Mar. 2016—Rev. 4, 21 pages.

* cited by examiner

OUTPUT VOLTAGE CONTROL METHOD TO AVOID LED TURN-ON FLASH

CROSS-REFERENCE TO RELATED APPLICATION

This application claims the benefit under 35 USC. § 119(e) of U.S. Provisional Application No. 62/911,676, filed Oct. 7, 2019, entitled "Output Voltage Control Method to Avoid LED Turn-On Flash," which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present disclosure relates generally to lighting systems comprising light emitting diodes (LEDs), and, more particularly, relates to apparatuses to prevent flashing of LEDs when power is first applied to the LEDs.

BACKGROUND

A driver for an LED lighting system regulates the current through a load comprising a plurality of interconnected LEDs. The driver must provide a voltage of sufficient magnitude to forward bias a plurality of LEDs connected in series. Many drivers are designed to operate over a range of forward voltages in accordance with the number of LEDs connected in series. For example, a typical LED driver can provide an output voltage of approximately 90 volts to drive 30 LEDs connected in series and can also provide an output voltage of approximately 50 volts to drive 17 LEDs in series. Known LED drivers do not adequately control the output voltage across the LEDs during a startup period. If the voltage across the LEDs is not controlled during the startup period, the voltage may temporarily be sufficient to cause the LEDs to flash on for a short duration and then turn off until the voltage becomes stable. The flash can be annoying and can also harm the LEDs under certain conditions. The flash may occur, for example, when driving a plurality of LEDs requiring a voltage at the lower end of the range of voltages of the LED driver.

SUMMARY

A need exists for an LED driver that operates over a wide range of voltages and that prevents the LEDs from flashing on and then off during a startup period.

One aspect of the embodiments disclosed herein is a light-emitting diode (LED) driver circuit that includes a DC-to-AC inverter that provides a primary AC voltage to the primary winding of an output transformer via a resonant tank circuit. The transformer has at least one secondary winding. An AC output voltage from the secondary winding is rectified to generate a DC voltage, which is applied to a load having a plurality of light-emitting diodes (LEDs). An overshoot control circuit is electrically connected in parallel with the primary winding of the transformer to prevent the DC voltage applied to the load from exceeding the forward bias of the LEDs during startup conditions until the resonant tank circuit is stabilized. The overshoot control circuit includes a first diode and a first capacitor and further includes a second diode and a second capacitor. The first and second capacitors absorb energy during alternate half cycles of the primary AC voltage until the resonant tank circuit is stabilized.

Another aspect of the embodiments disclosed herein is a driver circuit for providing DC power to a DC load having a plurality of light-emitting diodes (LEDs). The driver circuit comprises a reference bus and an input voltage bus that receives an input voltage referenced to the reference bus. A first semiconductor switch is coupled between the input voltage bus and a switched node. A second semiconductor switch is coupled between the switched node and the reference bus. A self-oscillating switch driver integrated circuit (IC) has a first driver output coupled to the first semiconductor switch and has a second driver output coupled to the second semiconductor switch. The switch driver IC selectively enables the first semiconductor and the second semiconductor switch at a variable frequency to generate a switched voltage signal on the switched node. The switch driver IC varies the variable frequency in response to a magnitude of an input parameter on a control terminal. A frequency control circuit is connected to the control terminal of the switch driver IC to provide the input parameter to the control terminal. The frequency control circuit provides the input parameter at a first magnitude when the input voltage is initially received on the input voltage bus. The frequency control circuit varies the input parameter to a second magnitude over a selected duration. The switch driver IC is responsive to the first magnitude to operate at a first frequency when the voltage source initially provides power to the input voltage bus and is responsive to the second magnitude to operate at a second frequency after the selected duration. A resonant tank circuit has an input connected to the switched node and has a resonant tank circuit output node. The resonant tank circuit comprises a resonant tank circuit inductor and a resonant tank circuit capacitor. The resonant tank circuit capacitor is connected between the resonant tank circuit output node and the reference bus. A DC-blocking capacitor has a first terminal and a second terminal. The first terminal of the DC-blocking capacitor is connected to the output node of the resonant tank circuit. An output transformer has a primary winding having a first terminal connected to the second terminal of the DC-blocking capacitor and having a second terminal connected to the reference bus. The output transformer has at least one secondary winding that generates a secondary AC voltage responsive to the switched voltage signal received by the primary winding. A rectifier circuit is connected to the at least one secondary winding of the output transformer to receive the secondary AC voltage. The rectifier circuit is configured to rectify the secondary AC voltage to provide a DC voltage to the DC load to produce a load current through the DC load. An overshoot control circuit is connected between the first terminal of the primary winding and the reference bus. The overshoot control circuit absorbs energy to prevent the DC voltage provided to the load from exceeding a load turn-on voltage when the input voltage is first applied to the input bus.

In certain embodiments in accordance with this aspect, the input parameter is a resistance. The resistance has a first lower magnitude when the voltage source initially provides the input voltage to the input voltage bus. The first lower magnitude causes the switch driver IC to operate at a first frequency. The resistance has a second higher magnitude after the selected duration. The second higher magnitude causes the switch driver IC to operate at a second frequency. The second frequency is lower than the first frequency.

In certain embodiments in accordance with this aspect, the overshoot control circuit comprises a first charge control diode and a first peak charging capacitor connected in series between the first terminal of the primary winding of the output transformer and the reference bus. The first charge control diode is connected to enable current to flow to the first peak charging capacitor when a voltage on the first terminal of the primary winding is positive with respect to the reference bus. The overshoot control circuit further comprises a second charge control diode and a second peak charging capacitor connected in series between the first terminal of the primary winding of the output transformer and the reference bus. The second charge control diode is connected to enable current to flow to the second peak charging capacitor when a voltage on the first terminal of the primary winding is negative with respect to the reference bus. In certain embodiments, the overshoot control circuit further comprises a first discharge resistor connected across the first peak charging capacitor to discharge the first peak charging capacitor when the voltage source is turned off. The overshoot control circuit further comprises a second discharge resistor connected across the second peak charging capacitor to discharge the second peak charging capacitor when the voltage source is turned off. In certain embodiments, the resonant tank circuit capacitor has a resonant tank capacitance. Each of the first peak charging capacitor and the second peak charging capacitor has a peak charging capacitance. The peak charging capacitance is greater than the resonant tank capacitance. In certain embodiments, the peak charging capacitance is at least ten times the resonant tank capacitance.

Another aspect of the embodiments disclosed herein is a method for preventing startup flash of a light-emitting diode (LED) load. The method comprises switching a switched node voltage between a first magnitude and a second magnitude at a variable frequency. The variable frequency has a first frequency at an initial startup and has a second frequency a selected duration after the initial startup. The method further comprises applying the switched node voltage to an input of a resonant tank circuit. The resonant tank circuit has a resonant tank circuit inductor and a resonant tank circuit capacitor. The resonant tank circuit inductor is connected between the input of the resonant tank circuit and a resonant tank circuit output node. The resonant tank circuit capacitor is connected between the resonant tank circuit output node and a reference bus. The method further comprises coupling an AC voltage from the resonant tank circuit output node through a DC-blocking capacitor to a first terminal of a primary winding of an output transformer. The primary winding has a second terminal connected to the reference bus. The method further comprises rectifying an AC voltage on a secondary winding of the output transformer to generate a DC output voltage to drive the LED load. The method further comprises coupling an overshoot control circuit between the first terminal of the primary winding of the output transformer and the reference bus. The overshoot control circuit absorbs energy to prevent the DC output voltage from exceeding a turn-on voltage for the LED load during the selected duration after the initial startup.

In certain embodiments in accordance with this aspect, coupling the overshoot circuit comprises coupling a first peak charging capacitor and a first charge control diode in series between the first terminal of the primary winding of the output transformer and the reference bus. The first charge control diode is connected such that current flows to the first peak charging capacitor only when a voltage on the primary winding of the output transformer is positive with respect to a voltage on the reference bus. Coupling the overshoot circuit further comprises coupling a second peak charging capacitor and a second charge control diode in series between the first terminal of the primary winding of the output transformer and the reference bus. The second charge control diode is connected such that current flows to the second peak charging capacitor only when a voltage on the primary winding of the output transformer is negative with respect to a voltage on the reference bus. In certain embodiments, the method further comprises selecting a capacitance for each of the first peak charging capacitor and the second peak charging capacitor to be greater than a capacitance of the resonant tank circuit capacitor. In certain embodiments, the capacitance of each of the first peak charging capacitor and the second peak charging capacitor is at least ten times the capacitance of the resonant tank circuit capacitor. In certain embodiments, the method further comprises coupling a first discharge resistor across the first peak charging capacitor. The first discharge resistor is operable to discharge the first peak charging capacitor when the switched node voltage is not switching. The method further comprises coupling a second discharge resistor across the second peak charging capacitor. The second discharge resistor is operable to discharge the second peak charging capacitor when the switched node voltage is not switching.

Another aspect of the embodiments disclosed herein is a driver circuit for providing DC power to a DC load having a plurality of light-emitting diodes (LEDs). The driver circuit comprises a voltage source that provides an input voltage on an input voltage bus. The input voltage is referenced to a reference voltage on a reference bus. A switching circuit generates a switched voltage on a switched node. The switched voltage switches between the input voltage and the reference voltage. A resonant tank circuit has an input connected to the switched node and has a resonant tank circuit output node. An output transformer has a primary winding. The primary winding has a first terminal coupled to the resonant tank circuit output node via a DC-blocking capacitor and has a second terminal coupled to the reference bus. The output transformer has at least one secondary winding. An output circuit is connected to the at least one secondary winding to provide power to the DC load. An overshoot control circuit is connected between the first terminal of the primary winding and the reference bus. The overshoot control circuit absorbs energy during an initial startup duration to prevent the DC voltage provided to the load from exceeding a load turn-on voltage during the initial startup duration.

In certain embodiments in accordance with this aspect, the overshoot control circuit comprises a first charge control diode and a first peak charging capacitor connected in series between the first terminal of the primary winding of the output transformer and the reference bus. The first charge control diode is connected to enable current to flow to the first peak charging capacitor when a voltage on the first terminal of the primary winding is positive with respect to the reference bus. A second charge control diode and a second peak charging capacitor are connected in series between the first terminal of the primary winding of the output transformer and the reference bus. The second charge control diode is connected to enable current to flow to the second peak charging capacitor when a voltage on the first terminal of the primary winding is negative with respect to the reference bus. In certain embodiments, the overshoot control circuit further comprises a first discharge resistor connected across the first peak charging capacitor to discharge the first peak charging capacitor when the voltage source is turned off. A second discharge resistor is connected across the second peak charging capacitor to discharge the second peak charging capacitor when the voltage source is turned off. In certain embodiments, the resonant tank circuit includes a resonant tank circuit capacitor having a resonant tank capacitance. Each of the first peak charging capacitor and the second peak charging capacitor has a peak charging capacitance. The peak charging capacitance is greater than the resonant tank capacitance. In certain embodiments, the peak charging capacitance is at least ten times the resonant tank capacitance.

In certain embodiments in accordance with this aspect, the switching circuit operates at a first operating frequency when the voltage source initially provides the input voltage. The switching circuit operates at a decreasing operating frequency during the initial startup duration. The switching circuit operates at a constant operating frequency after the initial startup duration, the constant operating frequency lower than the first operating frequency.

BRIEF DESCRIPTIONS OF THE SEVERAL VIEWS OF THE DRAWINGS

Figure 4:
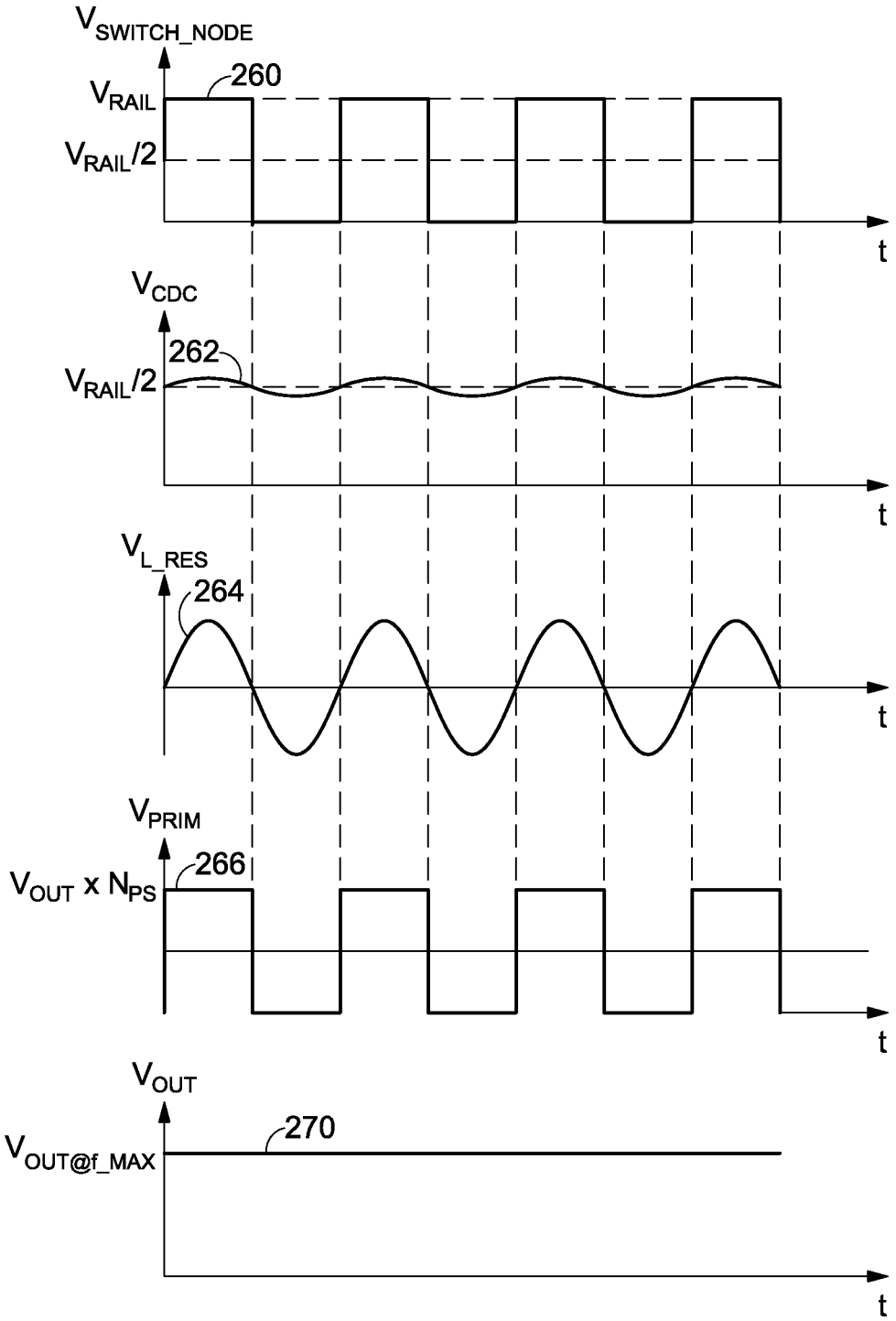

FIG. 4 illustrates waveforms that show the relationships of the voltage ($V_{SWITCH_NODE}$) from the switching circuit, the voltage ($V_{CDC}$) across the DC-blocking capacitor, the voltage ($V_{LRES}$) across the tank circuit inductor, the voltage ($V_{PRIM}$) across the primary winding of the output transformer and the output voltage ($V_{OUT}$) with respect to time when the operating frequency is at a maximum operating frequency.

Figure 5:
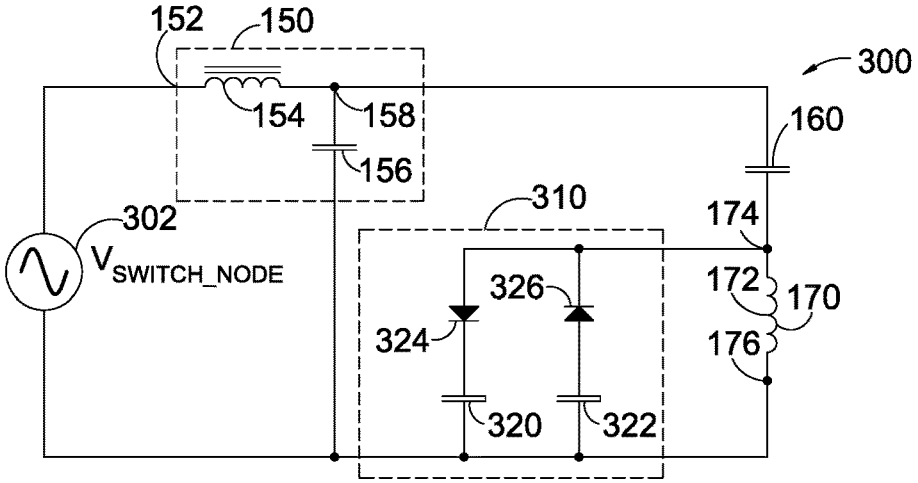

FIG. 5 illustrates an equivalent circuit of the half-bridge resonant converter during startup with an open-load condition.

Figure 6:
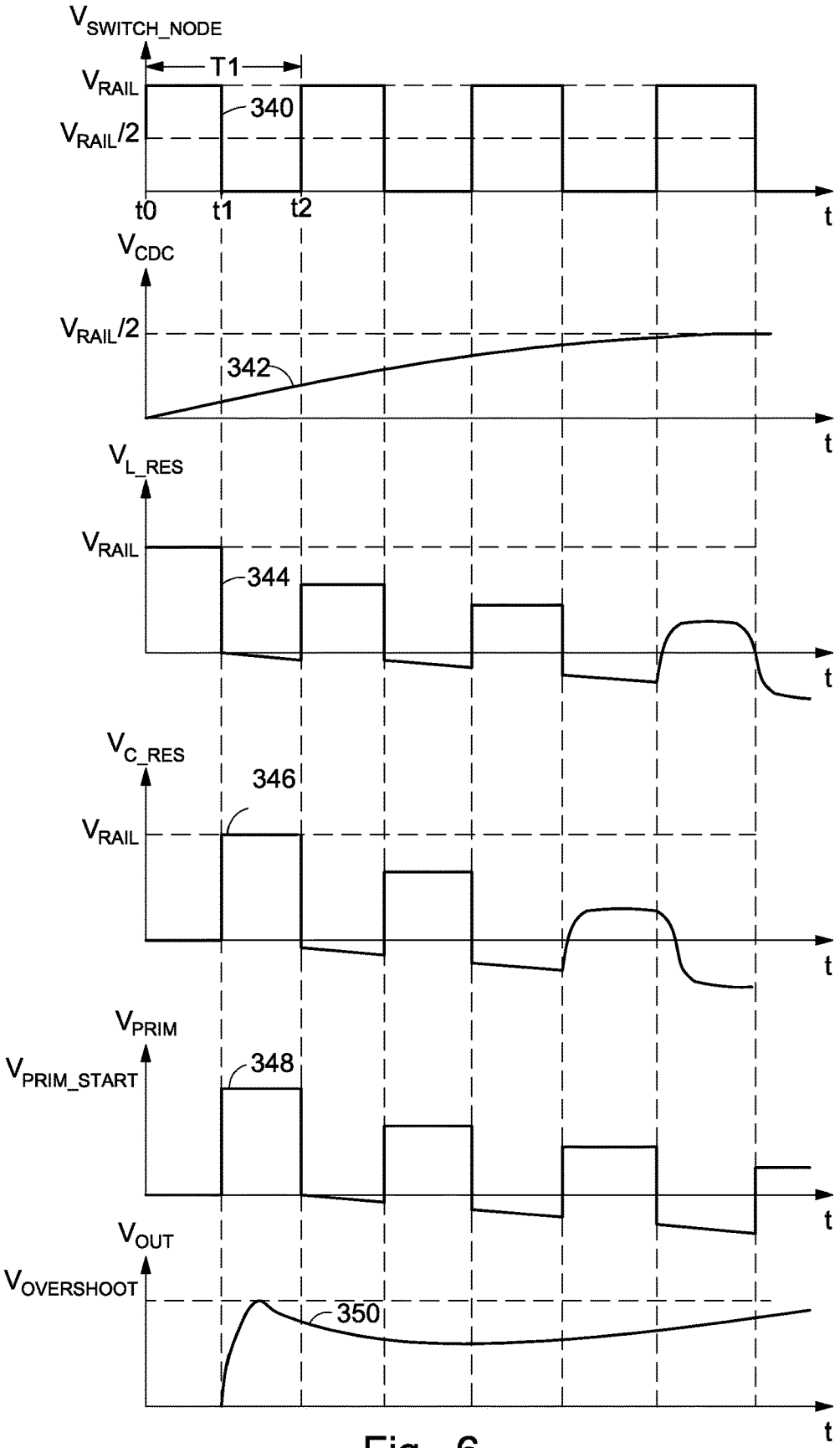

FIG. 6 illustrates waveforms that show the relationships of the voltage ($V_{SWITCH_NODE}$) from the switching circuit, the voltage ($V_{CDC}$) across the DC-blocking capacitor, the voltage ($V_{LRES}$) across the tank circuit inductor, the voltage ($V_{PRIM}$) across the primary winding of the output transformer, the output voltage ($V_{OUT}$) and the voltage ($V_{CRES}$) across the resonant tank circuit capacitor with respect to time when the operating frequency is varying during the initial resonant tank startup conditions.

Figure 7:
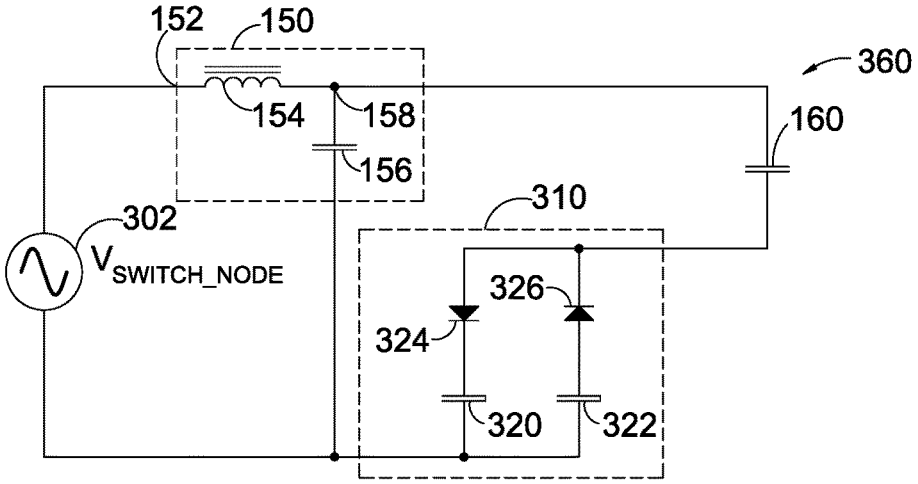

FIG. 7 illustrates a simplified equivalent resonant tank circuit during initial startup conditions.

Figure 8:
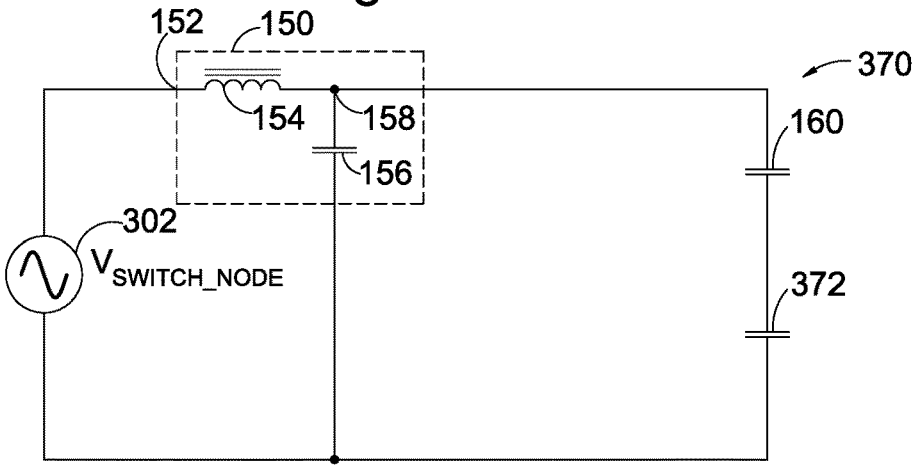

FIG. 8 illustrates a further simplified equivalent tank circuit during initial startup conditions.

Figure 1:
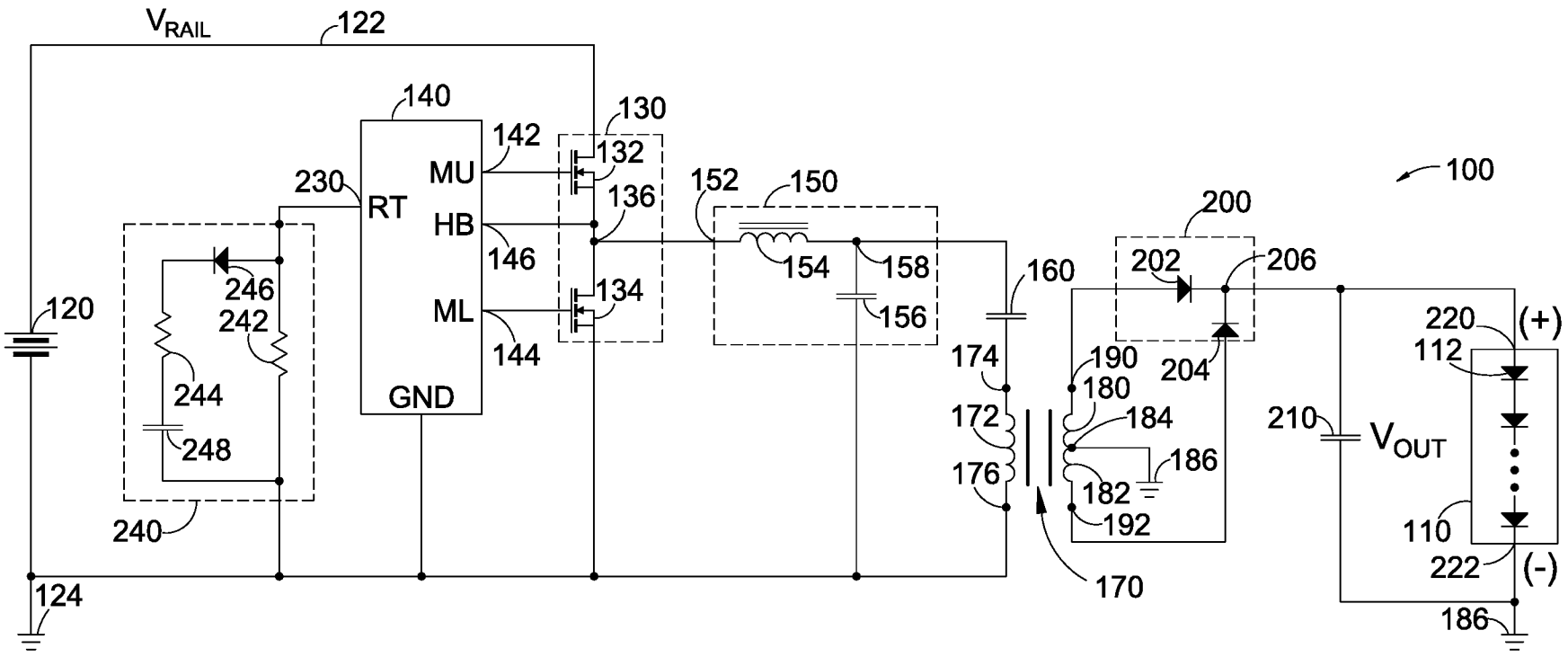
FIG. 1 illustrates a circuit diagram of an LED driver that may exhibit turn-on flash for an LED load.
Figure 9:
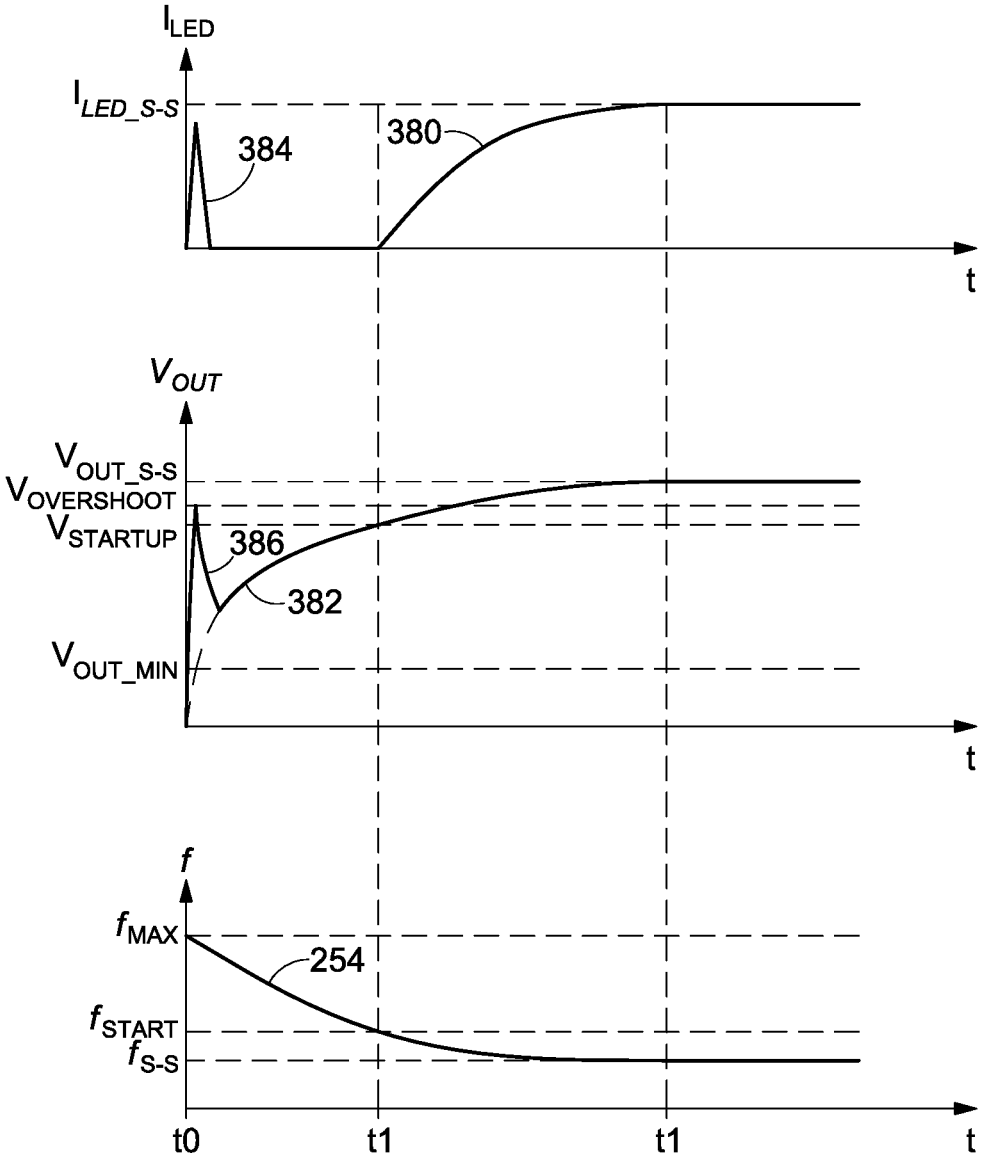

FIG. 9 illustrates waveforms that show the relationships of the LED current ($I_{LED}$), the output voltage ($V_{OUT}$) and the operating frequency ($f_{OP}$) with respect to time during an actual startup sequence for the LED driver of FIG. 1, the waveforms showing the spike in the output voltage and the spike in the LED current that occur before the resonant tank circuit stabilizes.

Figure 10:
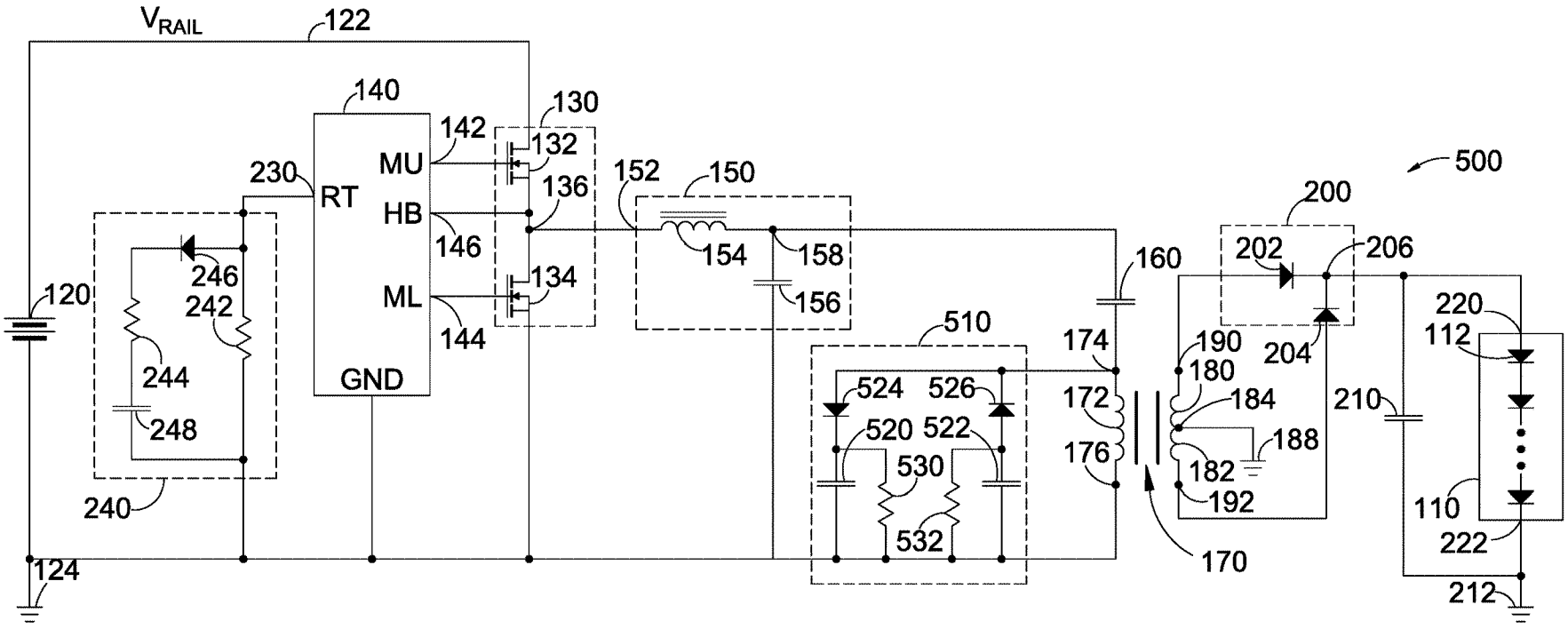

FIG. 10 illustrates the LED driver of FIG. 1 modified to include an overshoot control circuit to prevent the spikes in the output voltage and the LED current.

Figure 11:
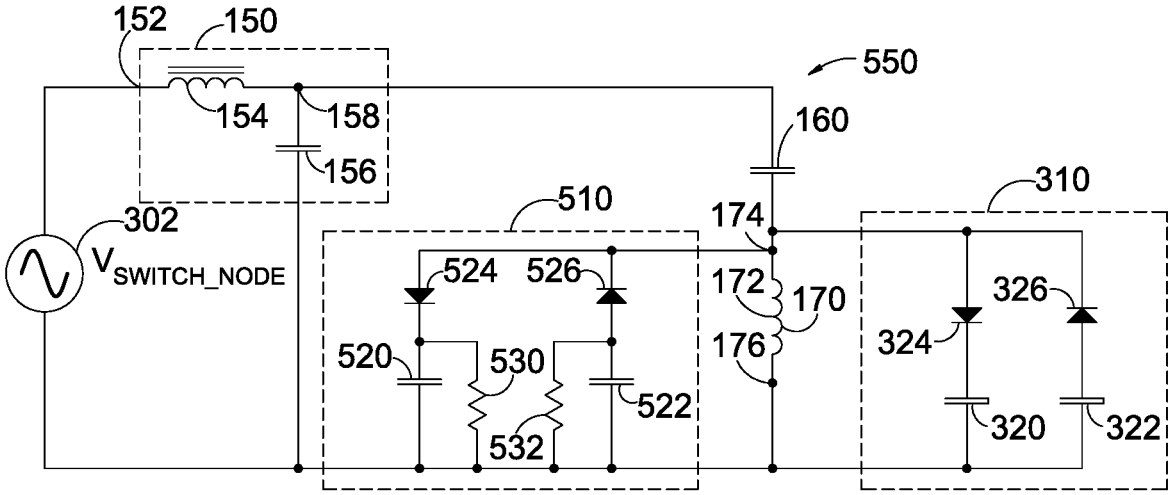

FIG. 11 illustrates the equivalent circuit of FIG. 5 modified to include the overshoot control circuit of FIG. 10.

Figure 12:
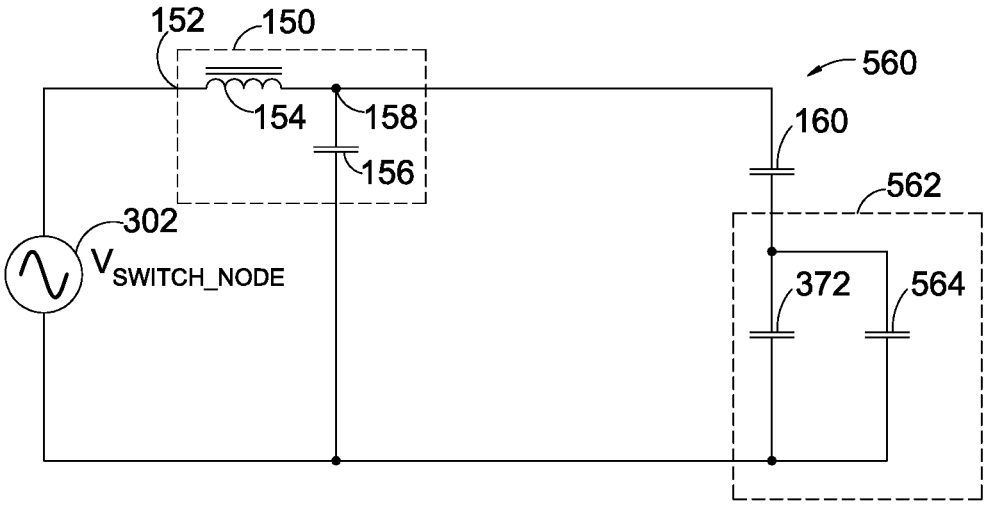

FIG. 12 illustrates the equivalent circuit of FIG. 11 simplified to represent the overshoot control circuit as a single equivalent capacitor with the single equivalent capacitor in parallel with the output buffer and filter capacitor.

DETAILED DESCRIPTION

The following detailed description of embodiments of the present disclosure refers to one or more drawings. Each drawing is provided by way of explanation of the present disclosure and is not a limitation. Those skilled in the art will understand that various modifications and variations can be made to the teachings of the present disclosure without departing from the scope of the disclosure. For instance, features illustrated or described as part of one embodiment can be used with another embodiment to yield a still further embodiment.

The present disclosure is intended to cover such modifications and variations as come within the scope of the appended claims and their equivalents. Other objects, features, and aspects of the present disclosure are disclosed in the following detailed description. One of ordinary skill in the art will understand that the present discussion is a description of exemplary embodiments only and is not intended as limiting the broader aspects of the present disclosure.

FIG. 1 illustrates an exemplary known LED driver (or driver circuit) 100 based on a popular topology for a half-bridge resonant DC-DC converter. The LED driver exhibits a high efficiency and good stability over a wide output range for the voltage applied to an LED load 110. For example, the output voltage may be approximately 50 volts when the LED load comprises 17 LEDs 112, and the output voltage may be approximately 90 volts when the LED load comprises 30 LEDs.

As shown in FIG. 1, the LED driver 100 is provided with DC power from a DC source 120. The DC source may be a power factor correction circuit (PFC) or other electronic constant voltage source. For ease of illustration, the DC source is shown as a battery that provides a constant DC voltage identified as $V_{RAIL}$. The DC voltage is plied to a voltage bus 122 and is referenced to a primary ground bus 124, which is also referred to herein as a reference bus.

The DC voltage $V_{RAIL}$ on the voltage bus 122 is applied to a half-bridge circuit 130 comprising a first switch 132 and a second switch 134. In the illustrated embodiment, the two switches are metal oxide semiconductor field effect transistors (MOSFETs). Each switch has a respective drain (upper) terminal, a respective source (lower) terminal and a respective control (gate) terminal. The drain (upper terminal) of the first switch is connected to the voltage bus. The source (lower terminal) of the first switch is connected to the drain (upper terminal) of the second switch at a switched node 136. The source (lower terminal) of the second switch is connected to the primary ground bus 124. The switched node is the output of the half-bridge circuit.

The first switch 132 and the second switch 134 are selectively turned on and turned off by a half-bridge driver integrated circuit (driver IC) 140. A first (MU) output 142 of the driver IC is connected to the gate of the first switch. A second (ML) output 144 of the driver IC is connected to the gate of the second switch. A half-bridge (HB) terminal 146 of the driver IC is connected to the switched node 136 of the half-bridge circuit 130. In the illustrated embodiment, the driver IC is a self-oscillating IC, such as an NCP1392B "High-Voltage Half-Bridge Driver with Inbuilt Oscillator"

from ON Semiconductor Company. The illustrated driver IC is a very cost-effective half-bridge drive IC for LED driver design. Other half-bridge driver ICs from other sources may also be used. The driver IC sets the steady-state frequency to maintain a constant output current for certain load range (e.g., a selected number of LEDs 112 connected in series in the LED load 110).

The switched node 136 of the half-bridge circuit 130 is connected to an input 152 of a resonant tank circuit 150. The main components of the resonant tank circuit are a resonant tank circuit inductor 154 and a resonant tank circuit capacitor 156. A first terminal of the resonant tank circuit inductor is connected to the input of the tank circuit and thus to the switched node of the bridge circuit. A second terminal of the resonant tank circuit is connected to a first terminal of the resonant tank circuit capacitor at a resonant tank circuit output node 158. A second terminal of the resonant tank circuit capacitor is connected to the primary ground bus 124.

A first terminal of a DC-blocking capacitor 160 is connected to the resonant tank circuit output node 158. A second terminal of the DC-blocking capacitor is connected to a first terminal 174 of a primary winding 172 of an output transformer 170. A second terminal 176 of the primary winding of the output terminal is connected to the primary ground bus 124.

The output transformer 170 includes a first secondary winding 180 and a second secondary winding 182. Respective first terminals of the two secondary windings are connected together at a center tap terminal 184, which is connected to a secondary ground bus (or reference bus) 186. The first secondary winding has a second terminal 190 that is also a first secondary output terminal 190 of the output transformer. The second secondary winding has a second terminal 192 this is also a second secondary output terminal 192 of the output transformer.

The first secondary output terminal 190 of the output transformer 170 is connected to an anode of a first rectifier diode 202 in an output rectifier circuit 200. The second secondary output terminal 192 of the output transformer is connected to an anode of a second rectifier diode 204 in the output rectifier circuit. A cathode of the first rectifier diode and a cathode of the second rectifier diode are connected together at a secondary output node 206. The secondary output node is connected to a first terminal of an output buffer and filter capacitor 210, which has a capacitance of $C_{OUT}$. A second terminal of the output buffer and filter capacitor is connected to the secondary ground bus 186. The two rectifier diodes and the output buffer and filter capacitor operate in a conventional manner to generate a DC output voltage $V_{OUT}$ on the secondary output node.

The secondary output node 206 of the output rectifier circuit 200 is also connected to a first (+) terminal 220 of the LED load 110. A second (−) terminal 222 of the LED load is connected to the secondary ground bus 186. The output voltage $V_{OUT}$ is applied across the LED load.

The driver IC 140 operates at a frequency controlled by a resistance applied to a timing resistor input terminal (RT) 230. A higher resistance applied to the timing resistor input terminal decreases the operating frequency. A lower resistance applied to the timing resistor input terminal increases the operating frequency. In the LED driver 100 of FIG. 1, a timing control circuit 240 is connected to the timing resistor input terminal. The timing control circuit includes a first timing circuit resistor 242. The first timing circuit resistor has a first terminal connected to the timing resistor input terminal and has a second terminal connected to the primary ground bus 124. The timing control circuit further includes a second timing circuit resistor 244, a timing circuit diode 246 and a timing circuit capacitor 248. The timing circuit diode has an anode connected to the timing resistor input terminal. The timing circuit diode has a cathode connected to a first terminal of the second timing resistor. The second timing circuit resistor has a second terminal connected to a first terminal of the timing circuit capacitor. The timing circuit capacitor has a second terminal connected to the primary ground bus. The first timing circuit resistor has first resistance $R_1$ that determines the maximum operating frequency of the driver IC. The second timing resistor has a second resistance $R_2$. The second resistor is selectively connected in parallel with the first resistor to determine the minimum operating frequency of the driver IC. The timing circuit capacitor operates to selectively connect the second resistor in parallel with the first resistor. When power is initially applied to the LED driver 100, timing circuit capacitor is discharged and charges through the second timing circuit resistor. Accordingly, when power is initially applied, a resistance $R_{IN}$ applied to the timing resistor input terminal of the driver IC has a minimum resistance $R_{IN_MIN}$, which is determined by the first resistance in parallel with the second resistance:

$$R_{IN_MIN} = \frac{R_1 \times R_2}{R_1 + R_2}$$

The minimum resistance $R_{IN_MIN}$ when power is initially applied causes the driver IC 140 to operate at a maximum operating frequency $f_{MAX}$. As the timing circuit capacitor charges, the effective resistance of $R_2$ in the circuit increases, which causes the overall resistance $R_{IN}$ to gradually increase to a maximum resistance $R_{IN_MAX}$, which is equal to $R_1$. When the overall resistance $R_{IN}$ has increased to $R_1$, the driver IC operates at a minimum operating frequency $f_{MIN}$.

The driver IC 140 operates in accordance with the following frequency control equation:

$$f_{OP} = I_{RT} \times 250\frac{\text{kHz}}{\text{mA}} = \frac{V_{REF}}{R_{IN}} \times 250\frac{\text{kHz}}{\text{mA}} \quad (1)$$

In Equation (1), $I_{RT}$ is the current out of the timing resistor input terminal 230 of the driver IC 140, which is determined by the resistance $R_{IN}$ applied to the timing resistor input terminal and by an internal reference voltage $V_{REF}$ of the driver IC. In the illustrated embodiment, the driver IC has a fixed internal reference voltage of 3.5 volts.

As discussed above, the maximum operating frequency $f_{MAX}$ occurs when the resistance $R_{IN}$ is lowest (e.g., $RI_N = R_{IN_MIN}$) when power is initially applied and the two timing circuit resistors 242, 244 are in parallel. Thus, Equation (1) can be rearranged as follows for $f_{MAX}$:

$$f_{MAX} = \frac{3.5}{\frac{R_1 \cdot R_2}{R_1 + R_2}} \times 250\frac{\text{kHz}}{\text{mA}} \quad (2)$$

As discussed above, when the timing circuit capacitor 248 is fully charged, the input resistance $RI_N$ increases to $R_1$ and the corresponding equation for the minimum operating $f_{MIN}$ is:

$$f_{MIN} = \frac{3.5}{R_1} \times 250 \frac{\text{kHz}}{\text{mA}} \quad (3)$$

As illustrated by Equations (2) and (3), in the transition from initial startup to steady-state condition, the operating frequency $f_{OP}$ sweeps from $f_{MAX}$ to $f_{MIN}$.

Figure 2:
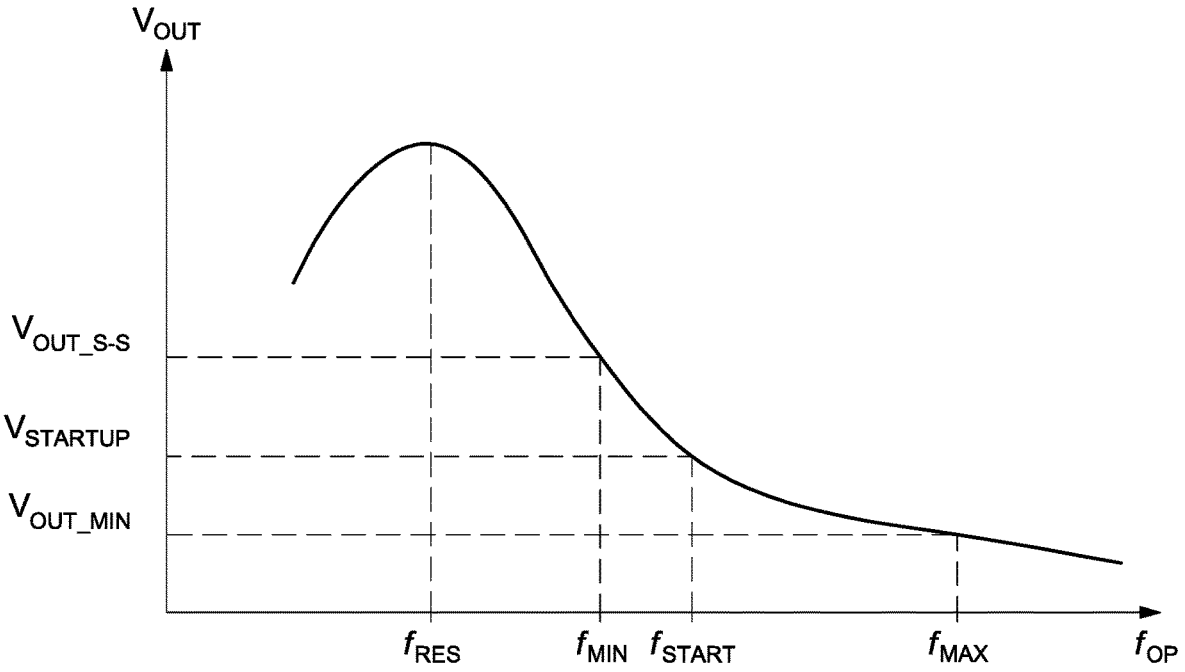
FIG. 2 illustrates the relationships of the output voltage ($V_{OUT}$) and the operating frequency ($f_{OP}$) of the LED driver.

FIG. 2 illustrates a relationship between the operating frequency $f_{OP}$ of the driver IC 120 and the output voltage $V_{OUT}$ on the output node 158 of the resonant tank circuit 150. As shown in FIG. 2, when the operating frequency is at maximum value, the tank output voltage is at minimum, $V_{OUT_MIN}$. As the timing circuit capacitor 248 changes to cause the operating frequency to sweep lower to a starting frequency $f_{STARTUP}$, the tank output voltage reaches a sufficient voltage to forward bias the LEDs 112 and to cause the LEDs to turn on and illuminate. As the timing circuit capacitor continues to charge, the resistance $R_{IN}$ reaches a maximum value of $R_1$ and the operating frequency $f_{OP}$ reaches the minimum operating frequency $f_{MIN}$. At the minimum operating frequency, the driver IC is in a steady-state operating condition and generates a steady-state output voltage $V_{OUT_S\text{-}S}$.

Figure 3:
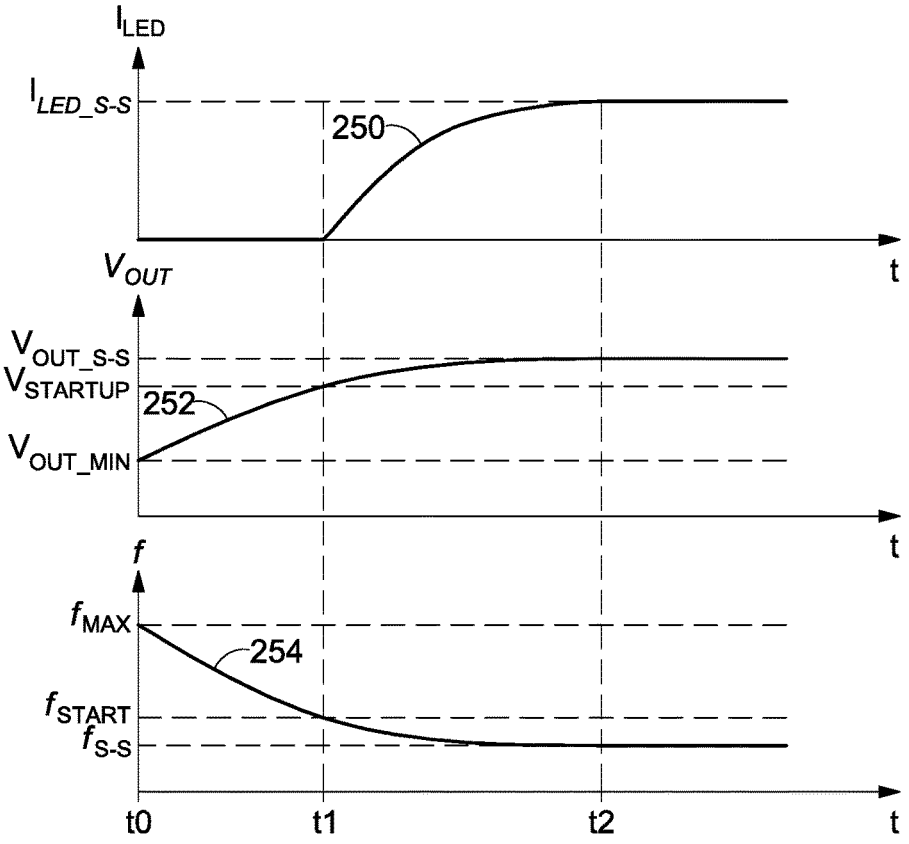
FIG. 3 illustrates waveforms that show the relationships of the LED current ($I_{LED}$), the output voltage ($V_{OUT}$) and the operating frequency ($f_{OP}$) with respect to time during an ideal startup sequence for the LED driver of FIG. 1.

FIG. 3 illustrates a set of ideal waveforms that occur during an ideal startup sequence that occurs when power is applied to the LED driver 100. An uppermost waveform 250 represents a current $I_{LED}$ through the series-connected LEDs 112 in the LED load 110. A middle waveform 252 represents a voltage $V_{OUT}$ on the secondary output node 206 connected to the first (+) terminal 220 of the LED load. A lowermost waveform 254 represents the operating frequency $f_{OP}$ of the driver IC 140 versus time.

In FIG. 3, t0 is the time when power is initially applied to the LED driver 100. Starting at t0, the operating frequency $f_{OP}$ is initially at the maximum operating frequency $f_{MAX}$ and gradually decreases. The output voltage $V_{OUT}$ at the secondary output node 206 of the output rectifier circuit 200 is initially at a minimum output voltage of $V_{OUT_MIN}$ and gradually increases as the operating frequency decreases. During a first interval from the time t0 to the time t1, the output voltage remains below a startup voltage magnitude $V_{STARTUP}$ and is insufficient to forward bias the LEDs 112 in the LED load 110. Thus, the LED current $I_{LED}$ remains at 0 throughout the first interval. At the time t1, the output voltage $V_{OUT}$ has increased to the startup voltage magnitude $V_{STARTUP}$, and current starts to flow through the LEDs in the LED load. The operating frequency when the output voltage reaches the startup magnitude is identified on the lowermost waveform as $f_{STARTUP}$. The operating frequency continues to decrease and the output voltage continues to increase during a second time interval from the time t1 to a time t2 until the output voltage reaches a steady-state output voltage $V_{OUT_S\text{-}S}$. The operating frequency is at a steady-state operating frequency $f_{S\text{-}S}$. During the second interval, the current through the LEDs continues to increase until the LED current reaches a steady-state current magnitude $I_{LED_S\text{-}S}$. The gradual increase in the LED current causes a "soft start" of the illumination provided by the LEDs without any turn-on flash of the LEDs. During an extended interval starting at the time t2 and continuing until power is discontinued, the driver IC 140 operates to maintain the LED current at the steady-state magnitude by maintaining the operating frequency at the steady-state operating frequency.

In the ideal waveforms of FIG. 3, the output voltage $V_{OUT}$ increases gradually from the magnitude $V_{OUT_MIN}$ to the startup magnitude $V_{STARTUP}$. The output voltage does not reach or exceed the startup magnitude until the operating frequency $f_{OP}$ has decreased to the startup frequency $f_{STARTUP}$ such the resonant tank circuit 150 is able to drive the primary winding 172 of the output transformer 170 with a sufficient voltage to maintain the output voltage at a magnitude at or above the startup magnitude. Once the startup magnitude is reached, the voltage does not decrease, and the LED current $I_{LED}$ continues to flow without interruption.

As indicated above, the ideal waveforms illustrated in FIG. 3 represent an ideal startup sequence; however, the ideal waveforms do not occur in an actual circuit constructed in accordance with the LED driver 100 under all conditions. For example, when the number of LEDs 112 in the LED load 110 is small such that the startup voltage is at or near the low end of the voltage range (e.g., around 50 volts), a spike in the output voltage $V_{OUT}$ may occur to cause the LEDs to flash on for a short duration during the startup sequence.

The cause of the startup spike can be understood in connection with the following description.

As discussed above, the LED driver 100 includes the resonant tank circuit 150, which is driven by the switched output of the half-bridge circuit 130 on the switched node 136. The output of the resonant tank circuit drives the primary winding 172 of the output transformer 170 via the DC-blocking capacitor 160. The secondary windings 180, 182 of the output transformer are applied to the output rectifier circuit 200, which produces the output voltage $V_{OUT}$. The operation of the LED driver during steady-state conditions is illustrated by a set of five waveforms in FIG. 4.

An uppermost waveform 260 in FIG. 4 illustrates the voltage $V_{SWITCH_NODE}$ on the switched node 136 when the operating frequency is at the steady-state operating frequency $f_{S\text{-}S}$. The switched node voltage has a square waveform centered about a DC offset voltage having a magnitude of approximately $V_{RAIL}/2$. The voltage on the switched node switches between approximately 0 volts (the ground reference voltage) and approximately $V_{RAIL}$ (the input voltage from the voltage source 120).

The output of the resonant tank circuit on the resonant tank circuit output node 158 is applied to the DC-blocking capacitor 160, which prevents DC current from flowing into the primary winding 172 of the output transformer 170. The DC-blocking capacitor has a large capacitance $C_{DC}$, which is typically greater than 10 times a capacitance $C_{RES}$ of the resonant tank circuit capacitor 156. The impedance of the DC-blocking capacitor is close to 0 at the steady-state operating frequency $f_{S\text{-}S}$ such that the DC-blocking capacitor does not affect the operation of the resonant tank circuit. Because the DC-blocking capacitor is effectively a short circuit at the steady-state operating frequency, the primary winding of the output transformer is effectively connected directly across the resonant tank circuit capacitor. As illustrated by a second waveform 262 in FIG. 4, a voltage $V_{CDC}$ across the DC-blocking capacitor is a DC voltage having a magnitude of approximately $V_{RAIL/2}$ and having a small ripple at the steady-state operating frequency $f_{S\text{-}S}$. The DC offset voltage across the DC-blocking capacitor allows the resonant tank circuit 150 to operate at the selected steady-state operating frequency. If the DC offset voltage across the DC-blocking capacitor deviates from $V_{RAIL}/2$, the resonant tank circuit will not be balanced, and the resonant tank circuit will adjust to reach the balanced condition.

As shown by a third waveform 264 in FIG. 4, a voltage $V_{LRES}$ across the resonant circuit inductor 154 is a quasi-sinusoidal voltage at the steady-state frequency $f_{S-S}$. The voltage is applied to the primary winding 172 of the output transformer 170. As illustrated by a fourth waveform 266 in FIG. 4, a voltage $V_{PRIM}$ across the primary winding appears as a square wave voltage because of the clamping effect of the first rectifier diode 202 and the second rectifier diode 204 in the output rectifier circuit 200. As illustrated by a fifth (lowermost) waveform 270 in FIG. 4, the output voltage $V_{OUT}$ is a substantially constant output voltage.

As discussed above, when power is initially applied to the LED driver 100 to cause a new startup, the driver IC 140, controls the operating frequency $f_{OP}$ of the voltages applied to the first switch 132 and the second switch 134 over a range of frequencies from the maximum operating frequency $f_{MAX}$ to the minimum operating frequency $f_{MIN}$. Eventually, the resonant tank circuit 150 is driven to the steady-state condition described above with respect to FIG. 4. Before switching of the first switch and the second switch occurs, the resonant tank circuit is "empty," which means that the current $I_{LRES}$ of the resonant tank circuit inductor 154 and the current $I_{PRIM}$ through the primary winding 172 of the output transformer 170 are both 0. The voltage $V_{CRES}$ across the resonant tank circuit capacitor 156 and the voltage $V_{CDC}$ across the DC-blocking capacitor are both 0. During initial startup before the LEDs 112 conduct, the LED load 110 is effectively an open circuit and no current flows in the output.

An equivalent circuit 300 during initial startup is illustrated in FIG. 5 to simplify the explanation of the operation of the LED driver during initial startup. In FIG. 5, the input 152 of the resonant tank circuit 150 is driven by an equivalent AC source 302 that generates the voltage $V_{SWITCH_NODE}$.

Because no current flows through the LED load 110 during the initial startup, the only secondary current flowing is the current flowing from the first secondary winding 180 through the first rectifier diode 202 to the output buffer and filter capacitor 210 and the current flowing from the second secondary winding 182 through the second rectifier diode 204 to the output buffer and filter capacitor. The first and second secondary windings, the first and second rectifier diodes and the output buffer and filter capacitor form a peak charging circuit. As shown in FIG. 5, an equivalent peak charging circuit 310 is shown reflected from the secondary of the output transformer back to the primary of the output transformer. The output buffer and filter capacitor is reflected back to the primary as a first equivalent energy storage capacitor 320 and a second equivalent energy storage capacitor 322. The first equivalent energy storage capacitor is in series with a first equivalent diode 324. The second equivalent energy storage capacitor is in series with a second equivalent diode 326. The first equivalent energy storage capacitor has a capacitance $C_{EQ1}$. The second equivalent energy storage capacitor has a capacitance $C_{EQ2}$. The capacitances of the equivalent energy storage capacitors are related to the capacitance $C_{OUT}$ of the output buffer and filter capacitor as follows:

$$C_{EQ1} = C_{EQ2} = C_{OUT} \times \frac{1}{N_{PS}^2} \tag{4}$$

In Equation (4), $N_{PS}$ is the ratio between the number of turns $T_{PR}$ of the primary winding 172 and the number of turns $T_{S1}$ of the first secondary winding 180 or the number of turns $T_{S2}$ of the second secondary winding 182 of the output transformer 170 (e.g., $N_{PS}=N_{PR}/N_{S1}=N_{PR}/N_{S2}$).

In FIG. 6, an uppermost waveform 340 illustrates the voltage $V_{SWITCH_NODE}$ on the switched node 136 as in FIG. 4. Because of the operation of the first switch 132 and the second switch 134, the voltage on the switched node switches between approximately 0 volts and approximately $V_{RAIL}$ such that the voltage is a square wave that is offset by $V_{RAIL}/2$. At steady state, the operating frequency $f_{OP}$ of the voltage on the switched node is substantially constant at $f_{S-S}$; however, in FIG. 6, the operating frequency $f_{OP}$ is not constant. Thus, the voltage on the switched node is illustrated as having a varying period. Initially, the voltage on the switched node has a first period T1 corresponding to the maximum frequency $f_{MAX}$. As the frequency decreases toward $f_{MIN}$, the period of the voltage on the switched node increases.

The DC-blocking capacitor 160 has a large capacitance (e.g., 100 nanofarads (100 nF)), which requires time for the voltage $V_{CDC}$ to be charged up to the steady-state voltage magnitude $V_{RAIL/2}$ as shown in FIG. 4. The effect of the charging time is illustrated by a waveform 342 representing $V_{CDC}$ in FIG. 6. The voltage $V_{CDC}$ across the DC-blocking capacitor starts at 0 volts and increases gradually toward the steady-state voltage $V_{RAIL/2}$.

As further shown in FIG. 6, at a time t0, the driver IC 140 initially controls the first (MU) output 142 and the second (ML) output 144 to turn the first switch 132 on and to turn the second switch 134 off. The conduction of the first switch causes the voltage on the switched node 136 to increase to the voltage $V_{RAIL}$ on the voltage bus 122. A voltage $V_{LRES}$ across the resonant tank circuit inductor 154 is represented by a waveform 344 in FIG. 6. The voltage $V_{LRES}$ initially increases to $V_{RAIL}$ to follow the voltage on the switched node because the voltage $V_{CDC}$ across the DC-blocking capacitor 160 cannot change instantaneously. A voltage $V_{CRES}$ on the resonant tank circuit capacitor 156 is represented by a waveform 346 in FIG. 6. The voltage $V_{CRES}$ cannot change instantaneously and remains at 0 volts for a duration. A voltage $V_{PRIM}$ across the primary winding 172 of the output transformer 170 is represented by a waveform 348 in FIG. 6. The voltage $V_{PRIM}$ initially corresponds to the voltage $V_{CRES}$ across the resonant tank circuit capacitor and starts at 0 volts because the voltage across the resonant tank circuit capacitor cannot change instantaneously. The output voltage $V_{OUT}$ is represented by a waveform 350 in FIG. 6.

As further shown in FIG. 6, at a time t1, the driver IC 140 controls the first (MU) output 142 and the second (ML) output 144 to turn off the first switch 132 and to turn on the second switch 134. The half-bridge output voltage on the switched node 136 is 0 volts because the conducting second switch connects the switched node to the primary ground bus 124. The current that flowed in the resonant tank circuit inductor 154 during the interval from t0 to t1 will keep flowing in the same direction and charge the resonant tank circuit capacitor 156 and the DC-blocking capacitor 160. The capacitance $C_{RES}$ of the resonant tank circuit capacitor is small (e.g., 8.2 nanofarads (8.2 nF), and the voltage $V_{CRES}$ across the resonant tank circuit capacitor is charged up to $V_{RAIL}$ quickly by the current from the resonant tank circuit inductor. The capacitance of the DC-blocking capacitor is much larger, and the voltage $V_{CDC}$ across the DC-blocking capacitor charges slowly such that the does not reach a steady-state value of VRAIL/2 for many cycles of the switched voltage on the switched node. The voltage $V_{CDC}$ across the DC-blocking capacitor 160 continues to charge until a time t2 when the voltage reaches a steady-state voltage magnitude $V_{RAIL}/2$. Accordingly, during the initial cycles, most of the voltage across the resonant tank circuit capacitor appears across the primary winding 172 of the output transformer 170.

As described above, FIG. 5 illustrates the equivalent peak charging circuit 310 connected in parallel with the primary winding 172 when the output is open with no current flowing through the LEDs 112 in the LED load 110. The capacitances $C_{EQ1}$ and $C_{EQ2}$ are sufficiently large such that the resonant frequency of the circuit comprising the first equivalent energy storage capacitor 320, the second equivalent energy storage capacitor 322 and the primary winding is much lower than the startup frequency. This causes the total impedance of the equivalent peak charging circuit to be capacitive. Thus, the inductance of the primary winding can be neglected for the electrical analysis, which allows the equivalent peak charging circuit 310 of FIG. 5 to be simplified to a simplified equivalent peak charging circuit 360 shown in FIG. 7 wherein the primary winding 172 of the output transformer 170 is removed.

As shown in FIG. 7, the first equivalent energy storage capacitor 320 stores energy during each positive half cycle, and the second equivalent energy storage capacitor 322 stores energy during each negative half cycle. As illustrated by a further equivalent circuit 370 in FIG. 8, the two equivalent energy storage capacitors of FIG. 7 are electrically equivalent to a single equivalent capacitor 372 with the capacitance of $C_{EQ}$, wherein $C_{EQ}=C_{EQ1}=C_{EQ2}$. As shown in FIG. 8, the DC-blocking capacitor 160 and the single equivalent capacitor are in series, and the series combination is in parallel with the resonant tank circuit capacitor 156. This configuration causes the voltage $V_{CRES}$ across the resonant tank circuit capacitor to be divided across the DC-blocking capacitor and the single equivalent capacitor such that the voltage $V_{CEQ}$ across the single equivalent capacitor is determined according to the following Equation (5):

$$V_{CEQ} = V_{CRES} \times \frac{C_{DC}}{C_{EQ} + C_{DC}} \tag{5}$$

The voltage across the single equivalent capacitor 372 is also the voltage $V_{PRIM}$ across the primary winding 172 of the output transformer 170. The voltage division shown in Equation (5) causes the voltage $V_{CEQ}$ across the single equivalent capacitor and across the primary winding during an interval from t1 to t2 (FIG. 6) to be determined according to the following Equation (6):

$$V_{PRIM} = V_{CEQ} = V_{RAIL} \times \frac{C_{DC}}{C_{EQ} + C_{DC}} = V_{RAIL} \times \frac{C_{DC}}{\left[C_2 \times \frac{1}{N_{PS}^2}\right] + C_{DC}} \tag{6}$$

The secondary voltage $V_{SEC}$ across each of the secondary windings is the primary voltage divided by the turns ratio $N_{PS}$. The secondary voltage is applied across the output buffer and filter capacitor 210 and across the LED load 110 as the voltage $V_{OUT}$. The peak secondary voltage prior to the charging of the DC-blocking capacitor 160 is determined by the following Equation (7):

$$V_{OUT} = V_{SEC} = \frac{V_{PRIM}}{N_{PS}} = V_{RAIL} \times \frac{C_{DC}}{\left[C_2 \times \frac{1}{N_{PS}^2}\right] + C_{DC}} \times \frac{1}{N_{PS}} \tag{7}$$

The peak in the secondary voltage VSEC prior to the circuit reaching steady-state conditions can be sufficiently large to overcome the total forward bias of the LEDs 112 in the LED load 110 to turn on the LEDs and cause an annoying turn-on flash.

In one example illustrating the cause of the turn-on flash, a 180-watt version of the LED driver 100 has an output current of 2 amperes through the LEDs and is able to operate over a range of LED loads requiring an output voltage that ranges from 50 volts to 90 volts. In one embodiment, the primary-to-secondary turns ratio NPS is 2, the capacitance $C_{DC}$ of the DC-blocking capacitor 160 is 100 nanofarads (100 nF), the capacitance $C_{OUT}$ of the output buffer and filter capacitor 210 is microfarad (1 μF), the inductance $L_{RES}$ of the resonant tank circuit inductor 154 is 500 microhenries (100 pH) and the capacitance $C_{RES}$ of the resonant tank circuit capacitor 156 is 8.2 nF. The voltage $V_{RAIL}$ of the voltage bus 122 is 470 volts. Applying the example parameters to Equation (7) results in the following Equation (8) for the output voltage $V_{OUT}$ during startup:

$$V_{OUT} = 470 \text{ volts} \times \frac{100 \text{ nF}}{\left(1000 \text{ nF} \times \frac{1}{2^2}\right) + 100 \text{ nF}} \times \frac{1}{2} = 67 \text{ volts} \tag{8}$$

In FIG. 9 the lowermost waveform 254 represents the operating frequency $f_{OP}$ of the driver IC 140 versus time as shown in FIG. 3. An upper waveform 380 represents the LED current $I_{LED}$ versus time. A middle waveform 382 represents the output voltage $V_{OUT}$ versus time. The spike in the turn-on voltage of 67 volts at the beginning of the initial startup is not sufficient to turn on the series of LEDs 112 requiring 90 volts to enable current flow; however, the turn-on voltage of 67 volts is sufficient to turn on a series of LEDs requiring only 50 volts to enable current flow. The temporary current flow appears as a turn-on current spike 384 in the LED current ($I_{LED}$) waveform 380 in FIG. 9. The current spike is caused by a corresponding voltage spike 386 in the output voltage $V_{OUT}$ waveform 382 in FIG. 9 to a voltage $V_{OVERSHOOT}$ (approximately 67 volts in the example). As shown in FIG. 9, shortly after the power is applied to the LED driver 100 at the time t0, the initial conditions in the resonant tank circuit 150 prevent the output voltage $V_{OUT}$ from increasing smoothly. Rather, the output voltage increases rapidly to form the voltage spike that has a maximum magnitude greater than the startup voltage $V_{STARTUP}$. The magnitude of the voltage spike is sufficient to turn on the LEDs if the total forward bias of the LEDs is 67 volts or less, which results in the illustrated current spike. When the current spike occurs, the energy stored in the output buffer and filter capacitor 210 is dissipated rapidly through the LEDs, which causes the output voltage to decrease such the LEDs turn off after a brief flash. The large turn-on spike of current is not controlled by the circuitry and the amount of energy in the turn-on spike could harm the LEDs.

After the turn-on current spike 384 occurs and the output buffer and filter capacitor 210 partially discharges, the output voltage $V_{OUT}$ reduces and then continues to increase with decreasing operating frequency $f_{OP}$ until the output voltage reaches the startup voltage $V_{STARTUP}$ at the time t1. Before the time t1, the output voltage is less than $V_{STARTUP}$, and the current $I_{LED}$ through the LEDs 112 is 0. At the time t2, the magnitude of the output voltage reaches $V_{STARTUP}$ again; however, the output voltage is now controlled by the circuitry. The LEDs 112 start to conduct and the LED current $I_{LED}$ begins increasing with further decreases in the operating frequency. The LED current continues to increase until the operating frequency reaches the steady-state operating frequency $f_{S\text{-}S}$ at the time t2.

Because of the potential harm to the LEDs 112 and because of the annoying turn-on flash, an improved circuit is desired to prevent the voltage overshoot and the current spike described above. Equation (7) suggests that the turn-on spike in the output voltage $V_{OUT}$ can be reduced (1) by increasing the capacitance $C_{OUT}$ of the output buffer and filter capacitor 210, (2) by decreasing the capacitance $C_{DC}$ of the DC-blocking capacitor 160; or (3) by decreasing the turns ratio $N_{PS}$ between the primary winding 172 and each secondary winding 180, 182 of the output transformer 170. Increasing the capacitance $C_{OUT}$ of the output buffer and filter capacitor is not practical because of cost and size considerations of a larger capacitor. For example, the cost of a 2.2 microfarad (2.2 μF) capacitor with a 250-volt rating may be three times the cost of a 1 microfarad (1 μF) capacitor with the same rating. The capacitance of the DC-blocking capacitor cannot be reduced substantially because basic design principles require the DC-blocking capacitor to have a capacitance 10-20 times greater than the capacitance of the resonant tank circuit capacitor 156. The turns ratio of the output transformer cannot be reduced because a reduction in the turns ratio changes the gain and reduces the efficiency of the resonant tank circuit 150. Accordingly, the following disclosure presents a new structure and method for reducing the spike in the output voltage during the initial turn-on of the LED driver 100.

The spike in the output voltage $V_{OUT}$ during initial turn-on of the LED driver 100 could be reduced by adding a large capacitor in parallel with the primary winding 172 of the output transformer 170 to increase the equivalent capacitance in Equation (6); however, increasing the equivalent capacitance across the primary winding decreases the circuit output gain during steady-state conditions. Accordingly, simply adding a parallel capacitor across the primary winding is not an acceptable way to reduce the spike in the output voltage.

FIG. 10 illustrates an improved LED driver (or driver circuit) 500 that reduces the spike in the output voltage $V_{OUT}$ during initial turn-on of the LED driver. In FIG. 10 components in the improved LED driver 500 corresponding to components in the previously described LED driver 100 of FIG. 1 are numbered as before and are described above. Unlike the previously described LED driver, the improved LED driver includes an overshoot control block 510 connected across the primary winding 172 of the output transformer 170. The control block includes a first peak charging capacitor 520, a second peak charging capacitor 522, a first charge-control diode 524, a second charge-control diode 526, a first discharge resistor 530 and a second discharge resistor 532.

The first charge-control diode 524 has an anode connected to a first terminal 174 of the primary winding 172 of the output transformer 170 and has a cathode connected to a first terminal of the first peak charging capacitor 520. A second terminal of the first peak charging capacitor is connected to the primary ground bus 124. The second charge-control diode has a cathode connected to the first terminal of the primary winding and has an anode connected to a first terminal of the second peak charging capacitor 522. A second terminal of the second peak charging capacitor is connected to the primary ground bus. The first discharge resistor 530 is connected across the first peak charging capacitor between the first terminal of the first peak charging capacitor and the primary ground bus. The second discharge resistor 532 is connected across the second peak charging capacitor between the first terminal of the second peak charging capacitor and the primary ground bus.

In the overshoot control block 510, the first peak charging capacitor 520 and the second peak charging capacitor 522 absorb transient energy during startup that occurs as described above. The first peak charging capacitor has a capacitance $C_{PC1}$ and the second peak charging capacitor has a capacitance $C_{PC2}$. The capacitance $C_{PC1}$ and the capacitance $C_{PC2}$ are the same (e.g., approximately 150 nanofarads (150 nF)) to balance the charging current in both directions of current flow. The first charge-control diode 524 charges the first peak charging capacitor when the voltage at the first terminal 174 of the primary winding 172 of the output transformer 170 is positive with respect to the primary ground bus 124. The second peak charge-control diode charges the second peak charging capacitor when the voltage at the first terminal of the primary winding is negative with respect to the primary ground bus. When the respective voltages on the first and second peak charging capacitors are the same as the respective positive and negative voltages on the primary winding, the first and second charge-control diodes stop conducting. When the charge-control diodes stop conducting, the overshoot control block 510 no longer affects the steady-state operating conditions of the LED driver 500.

The first discharge resistor 530 and the second discharge resistor 532 have large resistances (e.g., approximately 1 megohm (1 MΩ)) to slowly discharge the first peak charging capacitor 520 and the second peak charging capacitor 522, respectively, when the LED driver is powered off. The resistances of the two resistors are sufficiently large that the two resistors do not affect the charging of the first and second peak charging capacitors during the initial startup described above.

As illustrated by an equivalent circuit 550 in FIG. 11, the first peak charging capacitor 520 in the overshoot control block 510 is effectively in parallel with the first equivalent energy storage capacitor 320 shown in FIGS. 5 and 7. The second peak charging capacitor 522 in the control block is effectively in parallel with the second equivalent energy storage capacitor 322 shown in FIGS. 5 and 7.

As shown in a further simplified equivalent circuit 560 in FIG. 12, an equivalent capacitance block 562 is in series with the DC-blocking capacitor 160 as shown above with respect to the single equivalent capacitor 372 in FIG. 8. During startup, the equivalent capacitance block 562 comprises the single equivalent capacitor 372 of FIG. 8 in parallel with an equivalent peak charging capacitor 564. The single equivalent capacitor 372 has a capacitance $C_{EQ1}$ based on the capacitance of the output buffer and filter capacitor 210 as defined in Equation (4). The equivalent peak charging capacitor 554 has a capacitance CPC equal to the capacitance $C_{PC1}$ of the first peak charging capacitor 520, which is equal to the capacitance $C_{PC2}$ of the second peak charging capacitor 522.

A capacitance $C_{EQ_START}$ of the equivalent capacitor 552 during startup is determined by the following Equation (9):

$$C_{EQ_START} = C_{EQ} + C_{PC} = \left(C_{OUT} \times \frac{1}{N_{PS}^2}\right) + C_{PC} \tag{9}$$

A new magnitude for a startup voltage spike is obtained by substituting the new equivalent startup capacitance $C_{EQ_START}$ for $C_{EQ}$ in Equation (6) and Equation (7) as shown in the following Equation (10):

$$V_{OUT} = V_{RAIL} \times \frac{C_{DC}}{C_{EQ_{START}} + C_{DC}} \times \frac{1}{N_{PS}} = V_{RAIL} \times \frac{C_{DC}}{\left[C_{OUT} \times \frac{1}{N_{PS}^2}\right] + C_{PC} + C_{DC}} \times \frac{1}{N_{PS}} \tag{10}$$

Equation (10) differs from Equation (7) by including the additional term CPC in the denominator of the fraction defined by the capacitances in the circuit. This has the effect of increasing the equivalent capacitance $C_{EQ_START}$ such that the maximum voltage $V_{OUT}$ during startup is decreased substantially. Using the same parameters as previously discussed and including the capacitances of the first peak charging capacitor 520 and the second peak charging capacitor 522 of approximately 150 nanofarads, the maximum magnitude of the output voltage during startup $V_{OUT_NEW}$ is calculated as set forth in the following Equation (11):

$$V_{OUT} = 470 \text{ volts} \times \frac{100 \text{ nF}}{\left(1000 \text{ nF} \times \frac{1}{2^2}\right) + 150 \text{ nF} + 100 \text{ nF}} \times \frac{1}{2} = 47 \text{ volts} \tag{8}$$

As illustrated by Equation (8), the new turn-on spike for the improved LED driver 500 with the overshoot control block 510 will have a peak of 47 volt. This voltage spike is sufficiently less than the lowest forward bias of 50 volts of the minimum LED load of the LEDs 112 in the LED load 110 such that the voltage spike will not cause a turn-on flash during startup. This overshoot control method during startup is very effective to control the LED load turn-on flash. The method is cost effective to implement and does not affect any steady state operation of the improved LED driver.

The capacitances of the first peak charging capacitor 520 and the second peak charging capacitor 522 are much greater (e.g., 10 to 20 times greater) than the capacitance of the resonant tank circuit capacitor 156 that once the peak charging capacitors are charged during the initial startup, the peak charging capacitors have little if any effect on the operation of the LED driver 500 during steady-state operation. In the illustrated embodiment, the capacitance of each of the peak charging capacitors is 150 nF and the capacitance of the resonant tank circuit capacitor is 8.2 nF.

In addition to preventing turn-on flash, the overshoot control block 510 also helps to absorb transient high voltage surges that may occur across the primary winding 172 of the output transformer 170 caused by surges in the line voltage or caused by input voltage fluctuation. Thus, the startup overshoot control block provides at least partial overvoltage transient protection for the LEDs 112 in the LED load 110.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A driver circuit for providing DC power to a DC load having a plurality of light-emitting diodes (LEDs), the driver circuit comprising:

a reference bus;

an input voltage bus that receives an input voltage referenced to the reference bus;

a first semiconductor switch coupled between the input voltage bus and a switched node;

a second semiconductor switch coupled between the switched node and the reference bus;

a self-oscillating switch driver integrated circuit (IC) having a first driver output coupled to the first semiconductor switch and having a second driver output coupled to the second semiconductor switch, the switch driver IC selectively enabling the first semiconductor and the second semiconductor switch at a variable frequency to generate a switched voltage signal on the switched node, the switch driver IC varying the variable frequency in response to a magnitude of an input parameter on a control terminal;

a frequency control circuit connected to the control terminal of the switch driver IC, the frequency control circuit providing the input parameter to the control terminal, the frequency control circuit providing the input parameter at a first magnitude when the voltage source initially provides the input voltage on the input voltage bus, the frequency control circuit varying the input parameter to a second magnitude over a selected duration, the switch driver IC responsive to the first magnitude to operate at a first frequency when the voltage source initially provides power to the input voltage bus and responsive to the second magnitude to operate at a second frequency after the selected duration;

a resonant tank circuit having an input connected to the switched node and having a resonant tank circuit output node, the resonant tank circuit comprising a resonant tank circuit inductor and a resonant tank circuit capacitor, the resonant tank circuit capacitor connected between the resonant tank circuit output node and the reference bus;

a DC-blocking capacitor having a first terminal and a second terminal, the first terminal connected to the output node of the resonant tank circuit;

an output transformer having a primary winding having a first terminal connected to the second terminal of the DC-blocking capacitor and having a second terminal connected to the reference bus, the output transformer having at least one secondary winding that generates a secondary AC voltage responsive to the switched voltage signal received by the primary winding;

a rectifier circuit connected to the at least one secondary winding of the output transformer to receive the secondary AC voltage, the rectifier circuit configured to rectify the secondary AC voltage to provide a DC voltage to the DC load to produce a load current through the DC load; and an overshoot control circuit connected between the first terminal of the primary winding and the reference bus, the overshoot control circuit absorbing energy to prevent the DC voltage provided to the load from exceeding a load turn-on voltage when the input voltage is first applied to the input bus.

2. The driver circuit as defined in claim 1, wherein:

the input parameter is a resistance;

the resistance has a first lower magnitude when the voltage source initially provides the input voltage to the input voltage bus, the first lower magnitude causing the switch driver IC to operate at a first frequency; and the resistance has a second higher magnitude after the selected duration, the second higher magnitude causing the switch driver IC to operate at a second frequency, the second frequency lower than the first frequency.

3. The driver circuit as defined in claim 1, wherein the overshoot control circuit comprises:

a first charge control diode and a first peak charging capacitor connected in series between the first terminal of the primary winding of the output transformer and the reference bus, the first charge control diode connected to enable current to flow to the first peak charging capacitor when a voltage on the first terminal of the primary winding is positive with respect to the reference bus; and a second charge control diode and a second peak charging capacitor connected in series between the first terminal of the primary winding of the output transformer and the reference bus, the second charge control diode connected to enable current to flow to the second peak charging capacitor when a voltage on the first terminal of the primary winding is negative with respect to the reference bus.

4. The driver circuit as defined in claim 3, wherein the overshoot control circuit further comprises:

a first discharge resistor connected across the first peak charging capacitor to discharge the first peak charging capacitor when the voltage source is turned off; and a second discharge resistor connected across the second peak charging capacitor to discharge the second peak charging capacitor when the voltage source is turned off.

5. The driver circuit as defined in claim 3, wherein:

the resonant tank circuit capacitor has a resonant tank capacitance;

each of the first peak charging capacitor and the second peak charging capacitor has a peak charging capacitance; and the peak charging capacitance is greater than the resonant tank capacitance.

6. The driver circuit as defined in claim 5, wherein the peak charging capacitance is at least ten times the resonant tank capacitance.

7. A method for preventing startup flash of a light-emitting diode (LED) load, the method comprising:

switching a switched node voltage between a first magnitude and a second magnitude at a variable frequency, the variable frequency having a first frequency at an initial startup and having a second frequency a selected duration after the initial startup;

applying the switched node voltage to an input of a resonant tank circuit, the resonant tank circuit having a resonant tank circuit inductor and a resonant tank circuit capacitor, the resonant tank circuit inductor connected between the input of the resonant tank circuit and a resonant tank circuit output node, the resonant tank circuit capacitor connected between the resonant tank circuit output node and a reference bus;

coupling an AC voltage from the resonant tank circuit output node through a DC-blocking capacitor to a first terminal of a primary winding of an output transformer, the primary winding having a second terminal connected to the reference bus;

rectifying an AC voltage on a secondary winding of the output transformer to generate a DC output voltage to drive the LED load; and coupling an overshoot control circuit between the first terminal of the primary winding of the output transformer and the reference bus, the overshoot control circuit absorbing energy to prevent the DC output voltage from exceeding a turn-on voltage for the LED load during the selected duration after the initial startup, wherein coupling the overshoot circuit comprises:

coupling a first peak charging capacitor and a first charge control diode in series between the first terminal of the primary winding of the output transformer and the reference bus, the first charge control diode connected such that current flows to the first peak charging capacitor only when a voltage on the primary winding of the output transformer is positive with respect to a voltage on the reference bus; and coupling a second peak charging capacitor and a second charge control diode in series between the first terminal of the primary winding of the output transformer and the reference bus, the second charge control diode connected such that current flows to the second peak charging capacitor only when a voltage on the primary winding of the output transformer is negative with respect to a voltage on the reference bus.

8. The method as defined in claim 7, further comprising selecting a capacitance for each of the first peak charging capacitor and the second peak charging capacitor to be greater than a capacitance of the resonant tank circuit capacitor.

9. The method as defined in claim 8, wherein the capacitance of each of the first peak charging capacitor and the second peak charging capacitor is at least ten times the capacitance of the resonant tank circuit capacitor.

10. The method as defined in claim 7, further comprising:

coupling a first discharge resistor across the first peak charging capacitor, the first discharge resistor operable to discharge the first peak charging capacitor when the switched node voltage is not switching; and coupling a second discharge resistor across the second peak charging capacitor, the second discharge resistor operable to discharge the second peak charging capacitor when the switched node voltage is not switching.

11. A driver circuit for providing DC power to a DC load having a plurality of light-emitting diodes (LEDs), the driver circuit comprising:

a voltage source that provides an input voltage on an input voltage bus, the input voltage referenced to a reference voltage on a reference bus;

a switching circuit that generates a switched voltage on a switched node, the switched voltage switching between the input voltage and the reference voltage;

a resonant tank circuit having an input connected to the switched node and having a resonant tank circuit output node;

an output transformer having a primary winding, the primary winding having a first terminal coupled to the resonant tank circuit output node via a DC-blocking capacitor and having a second terminal coupled to the reference bus, the output transformer having at least one secondary winding;

an output circuit connected to the at least one secondary winding to provide power to the DC load; and an overshoot control circuit connected between the first terminal of the primary winding and the reference bus, the overshoot control circuit absorbing energy during an initial startup duration to prevent the DC voltage provided to the load from exceeding a load turn-on voltage during the initial startup duration, wherein the overshoot control circuit comprises:

a first charge control diode and a first peak charging capacitor connected in series between the first terminal of the primary winding of the output transformer and the reference bus, the first charge control diode connected to enable current to flow to the first peak charging capacitor when a voltage on the first terminal of the primary winding is positive with respect to the reference bus; and a second charge control diode and a second peak charging capacitor connected in series between the first terminal of the primary winding of the output transformer and the reference bus, the second charge control diode connected to enable current to flow to the second peak charging capacitor when a voltage on the first terminal of the primary winding is negative with respect to the reference bus.

12. The driver circuit as defined in claim 11, wherein the overshoot control circuit further comprises:

a first discharge resistor connected across the first peak charging capacitor to discharge the first peak charging capacitor when the voltage source is turned off; and a second discharge resistor connected across the second peak charging capacitor to discharge the second peak charging capacitor when the voltage source is turned off.

13. The driver circuit as defined in claim 12, wherein:

the resonant tank circuit includes a resonant tank circuit capacitor having a resonant tank capacitance;

each of the first peak charging capacitor and the second peak charging capacitor has a peak charging capacitance; and the peak charging capacitance is greater than the resonant tank capacitance.

14. The driver circuit as defined in claim 13, wherein the peak charging capacitance is at least ten times the resonant tank capacitance.

15. The driver circuit as defined in claim 11, wherein:

the switching circuit operates at a first operating frequency when the voltage source initially provides the input voltage;

the switching circuit operates at a decreasing operating frequency during the initial startup duration; and the switching circuit operates at a constant operating frequency after the initial startup duration, the constant operating frequency lower than the first operating frequency.

* * * * *